US005529527A

United States Patent [19]

Watkins

[11] Patent Number: 5,529,527

[45] Date of Patent: Jun. 25, 1996

[54] READILY REMOVABLE CONFETTI CANNONS

[76] Inventor: James O. Watkins, 14920 Mt. Nebo Rd., Poolesville, Md. 20837

[21] Appl. No.: 111,608

[22] Filed: Aug. 25, 1993

Related U.S. Application Data

[63] Continuation-in-part of Ser. No. 51,355, Apr. 23, 1993, Pat. No. 5,352,148.

[51] Int. Cl.[6] ..... A63H 37/00

[52] U.S. Cl. ..... 446/475; 446/176; 124/60; 124/71; 124/74; 222/325

[58] Field of Search ..... 446/176, 199, 446/211, 212, 429, 475; 124/60, 70, 71, 74; 222/4, 5, 637, 325

[56] References Cited

U.S. PATENT DOCUMENTS

| | | | |
|---|---|---|---|
| 825,843 | 7/1906 | Kliemandt | 446/475 |
| 1,122,421 | 12/1914 | Redington et al. | 446/176 |
| 2,153,419 | 4/1939 | Hoffman | 222/4 |
| 2,345,173 | 3/1944 | Baggott | 446/475 |
| 2,375,314 | 5/1945 | Mills | 124/70 |
| 2,725,048 | 11/1955 | Koogle | 124/74 |
| 2,746,737 | 7/1956 | Resch | 446/211 |
| 3,112,645 | 12/1963 | Glass | 222/5 |
| 3,345,977 | 10/1967 | Hall | 124/77 |
| 3,382,859 | 5/1968 | Myers | 124/70 |
| 3,669,087 | 6/1972 | Hamrick | 124/74 |
| 4,266,813 | 5/1981 | Oliver | 285/12 |
| 4,446,990 | 5/1984 | Stevenson et al. | 222/637 |
| 4,678,377 | 7/1987 | Bouchard | 222/637 |
| 5,015,211 | 5/1991 | Reveen | 446/475 |
| 5,149,290 | 9/1992 | Reveen | 446/475 |
| 5,180,109 | 1/1993 | Schwartzbauer et al. | 222/637 |
| 5,226,567 | 7/1993 | Sansalone | 222/637 |

FOREIGN PATENT DOCUMENTS

| | | | |
|---|---|---|---|
| 1710086 | 2/1992 | U.S.S.R. | 446/475 |

*Primary Examiner*—Robert A. Hafer
*Assistant Examiner*—Jeffrey D. Carlson

[57] ABSTRACT

Cannons for launching confetti into the air are disclosed in which readily removable connectors secure the elongated hollow tubes filled with confetti to a source of compressed gas. The elongated hollow tubes may be composed of plastic or cardboard, and the readily removable connectors include threaded joints, bayonet joints and quick-disconnect couplings.

3 Claims, 4 Drawing Sheets

READILY REMOVABLE CONFETTI CANNONS

This application is a continuation-in-part of application Ser. No. 08/051,355 filed Apr. 23, 1993, now U.S. Pat. No. 5,352,148, the complete disclosure of which is hereby incorporated by reference.

FIELD OF THE INVENTION

This invention relates to amusement devices, and more particularly to devices for launching confetti, streamers and the like into the air. More specifically, the present invention relates to elongated, hollow tubes which may be readily connected to, and disconnected from, sources of compressed gas. In some preferred embodiments, the tubes may be pre-loaded with confetti or streamers or the like before attachment to the compressed gas source, and/or the tubes may be constructed so as to be disposable after one or a few uses, and disposable in an environmentally friendly manner.

BACKGROUND

Bursts of confetti and/or streamers shot out of so-called "cannons" connected to compressed gas sources have long been used at shows, parties, circus acts and other events so as to produce displays of sound, color and motion. However, such cannons have been made of heavy gauge plastic, such as P.V.C. for example, having wall thicknesses of one-eighth inch or greater. As such, these cannons are much too expensive to be used once and thrown away. In addition, such thick-walled P.V.C. cannons do not decompose such that discarding them after a single use would present a problem to the landfills and the environment.

In addition to these cost and environmental factors, prior cannons have been designed so as to remain connected to the compressed gas source; such sources being in the form of a compressed air line, tank or cylinder, or a $CO_2$ cartridge. That is, the systems have been designed with the closed ends of the cannons bolted or otherwise relatively permanently connected to the compressed gas source, and the cannons are re-used by refilling them with confetti and/or streamers after each use. This presents a serious problem when the cannons are mounted in the rafters or other structures near the ceiling of a theater, hotel ballroom, auditorium or the like where it is difficult to reach them and reload them. This is particularly true with conventional confetti which is difficult and time-consuming to pack and "fluff" into the cannons. As a result, such reloading operations are very slow, labor-intensive and costly operations, particularly when repeatedly shooting half a dozen or more cannons at each of eight or more shows each day. In that situation, there is the further problem that there may not be sufficient time between shows to reload more than several cannons. Thus, the number of cannons which can be used at each show is sometimes limited by the time required for refilling the cannons. In addition, with the use of conventional confetti, it is impossible to predetermine the size or shape of the cloud of confetti produced each time because the compacting and fluffing procedures cannot be held constant.

SUMMARY

The present invention solves all of the above-indicated problems by providing elongated, hollow tubes with the connection means between the tube and the compressed gas source being designed to provide a readily separable connection. In this manner, the tubes of this invention can be preloaded with confetti and/or streamers before being temporarily connected to the compressed gas source for a given show or performance. After being discharged of their contents during the show, the tubes may be easily and rapidly disconnected from the gas source, and may be discarded or refilled at a convenient location.

In addition, the tubes of some of the preferred embodiments of the present invention are composed entirely of cardboard, or substantially all cardboard, or at a minimum of much thinner plastic than prior cannons. Thus, the tubes of the present invention are sufficiently low cost, and are either completely biodegradable, or much more biodegradable than the prior cannons, such that they are economically and environmentally able to be discarded after one or a few uses; i.e., they are fully "disposable" as this term is used herein. This completely eliminates the refilling problems discussed above. In addition, if any of the tubes are to be refilled, such refilling may be done on the ground where it is convenient to do so, and with special filling apparatus, whereas such apparatus cannot be used with the prior cannons permanently mounted on the rafters or other ceiling structures.

The present invention further includes filling the tubes with stacks of elongated rectangular shaped confetti, as will be more fully described hereafter. The use of stacks or bundles of such confetti, known under the trademark Flutter Fetti confetti, not only produces much more dramatic and predictable displays, but also substantially decreases the time to fill or refill the tubes.

These and other advantages will become apparent from the following description of several preferred embodiments of the invention as shown in the following illustrative drawings.

DETAILED DESCRIPTION

Figure 1:
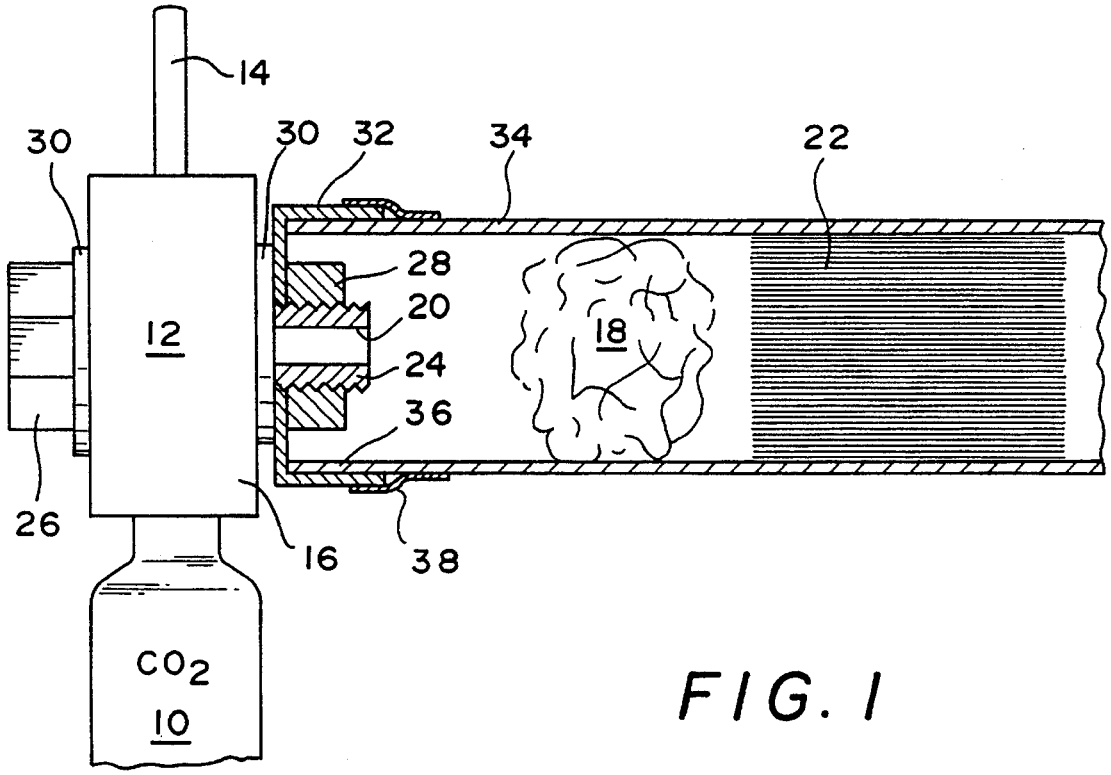
FIG. 1 is a side elevational view, partly in cross-section, showing a $CO_2$ cartridge and actuator connected to an elongated, hollow tube comprising one embodiment of the present invention.

Referring to FIG. 1, numeral 10 designates a conventional, commercially available $CO_2$ cartridge which is threaded into a conventional and commercially available actuator 12. Actuator 12 includes a handle 14 which is pivoted within body 16 of the actuator, and it will be understood that, when handle 14 is pulled by the user, the inner portion of the pivoted handle actuates a hollow pin (not shown) which ruptures the seal on the $CO_2$ cartridge. High pressure $CO_2$ then flows through a passage within actuator body 16 and into a hollow passage 20 of a threaded bolt 24. Bolt 24 has a head 26 and a threaded shank the latter of which receives a locking nut 28. Preferably, one of a pair of washers 30 is provided on each side of actuator body 16 to provide mechanical rigidity and to compress a pair of O-ring seals (not shown) which surround bolt 24 on each side of actuator body 16. It will be understood that all of the details of such conventional and commercially available actuators are well known in the $CO_2$ cartridge and actuator industry such that further detailed description thereof is not necessary for a full understanding of the present invention.

As further shown in FIG. 1, a supporting cup 32 having a U-shaped cross-section is permanently secured to the actuator by bolt 24 and nut 28. Cup or mounting member 32 is preferably composed of thin metal, such as a brass or copper or aluminum alloy. Alternatively, cup 32 may be composed of plastic, such as P.V.C. for example, but regardless of composition, the wall thickness of cup 32 is made less than one-eighth inch, and more preferably in the range of one-sixteenth to one-thirty second of an inch for reasons of better sealing as will be more fully explained hereinafter.

Telescoped within supporting cup 32 is a disposable tube 34 which, in one preferred embodiment, is composed entirely of cardboard, preferably "spiral-wound", "crafted" cardboard as these terms are known in the cardboard industry. Such cardboard is fully biodegradable, and a wall thickness in the order of one-eighth inch or less is preferred. The diameters of such tubes may vary widely, but generally, diameters of three-quarters to two inches, and lengths of eighteen inches to four feet, are preferred for most shows. However, larger diameters and/or six foot lengths are also possible for producing large displays.

End portion 36 of tube 34 is made with an outer diameter of a size such as to provide a snug fit with the inner wall surface of cup 32 such that a first gas seal is formed there between. However, if increased sealing is desired, or increased mechanical connection between the cup and the disposable tube is desired, a piece of removable adhesive tape 38 may be wrapped once or twice about the joint as illustrated. It is for this reason that cup 32 is preferably of the thin-walled construction previously indicated, as well as to decrease the amount of tube material to be discarded into the environment.

Tube 34 may be filled before or after the tube and cup are assembled. In either event, tube 34 is filled with confetti, and/or streamers, and/or paper or plastic "bubbles", rings or other shapes all of which are hereinafter referred to generically as multiple forms of confetti. As previously indicated, one preferred conform of confetti comprises Flutter Fetti confetti as described in parent application Ser. No. 08/051,355 now U.S. Pat. No. 5,352,148. Such confetti is of elongated rectangular shape having length to width ratios in the range of 2.5 to 7. Such confetti may be loaded in stacks, such as stack 22 shown in FIG. 1 whereby the loading time may be reduced to only one-fifth of the time previously required. In addition, the display produced by such elongated rectangular shapes of confetti is much more striking because each stack rises in the air and then bursts into hundreds of pieces. Each piece of Flutter Fetti confetti then flutters as it floats relatively slowly to the ground producing a unique display of motion and color. Furthermore, each load of Flutter Fetti confetti is consistent in producing a predictable size and shape of display.

After the lightweight articles have been shot from the tube, tape 38 is easily removed, and a new tube may be inserted in cup 32. The new tube may be preloaded with lightweight articles, with or without a temporary plug 18 in the end of the tube as may be desired. Plug 18 may be comprised of any suitable material such as, for example, a cork wedged into the end of the tube, or a plastic cap on the tube, or a crumpled piece of tissue paper as illustrated. Plug 18 is illustrated in phantom line since it will be understood that the plug is removed from the end of tube 34 before the latter is fitted into cup 32. Accordingly, it will be apparent that very little time is required to prepare for the next shot. Empty tube 34 may be discarded with no injury to the environment since it is entirely cardboard and highly biodegradable. Alternatively, the tube may be refilled and reused; such refilling being done either at the site of the show, or the lightweight tubes may be shipped back to the factory for refilling. In either event, the empty tube may be quickly removed from the cup and the compressed gas source, and quickly replaced by new tubes, preferably preloaded and ready to shoot with no filling time required between uses.

While the foregoing description relates to the use of the tubes of the present invention in connection with a $CO_2$ cartridge and actuator assembly, which assembly may be hand held or mounted in the ceiling works or elsewhere in a theater, it is to be understood that tube 34, as well as other tubes of the present invention, are equally usable with conventional compressed air tanks and/or pneumatic lines. Thus, mounting cup 32 may be secured directly or indirectly to such tanks or lines as a permanent connection, and used in the same manner as described above. Alternatively, such tanks or lines may be connected permanently to other embodiments of the present invention as will now be described.

Figure 2:
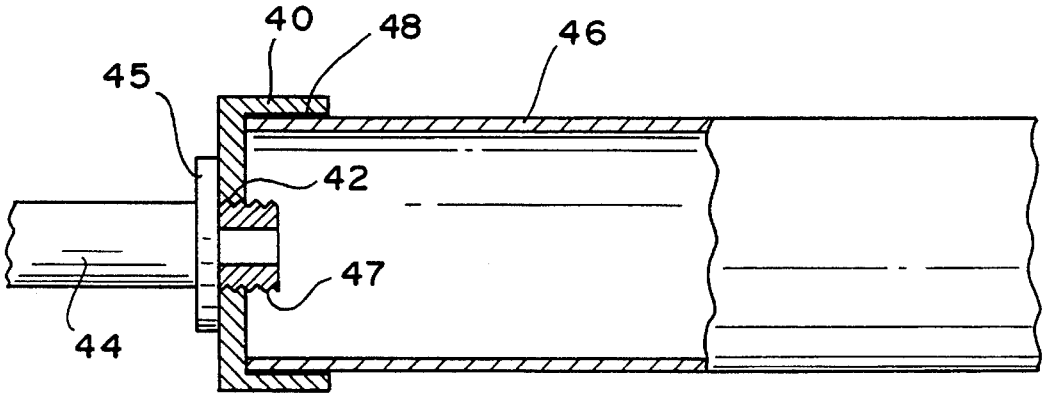
FIGS. 2–8 are side elevational views, partly in cross-section, showing elongated, hollow tubes comprising alternative embodiments of the present invention.

Referring to FIG. 2, a cup 40 is provided with a threaded hole 42 which is of a size to receive threads 47 on the end of a compressed gas fitting 44. Fitting 44 has a flange 45 and is permanently connected directly or indirectly to one of the sources of compressed gas described above. Cup 40 may be composed of cardboard or plastic and has an internal diameter such as to receive the end of elongated tube 46; the latter being composed of cardboard or thin-walled plastic. However, instead of a removable, snug fit between tube 46 and cup 40 as in the FIG. 1 embodiment, the end of tube 46 is permanently connected to cup 40 such as by glue 48. In this embodiment, the readily removable or detachable feature is provided by simply unscrewing cup 40 from threaded fitting 44 after the lightweight articles have been shot out of the tube. A new tube having its own permanently attached cup, and preferably preloaded with lightweight articles, is then screwed onto threaded fitting 44 for the next shot.

Figure 3A:
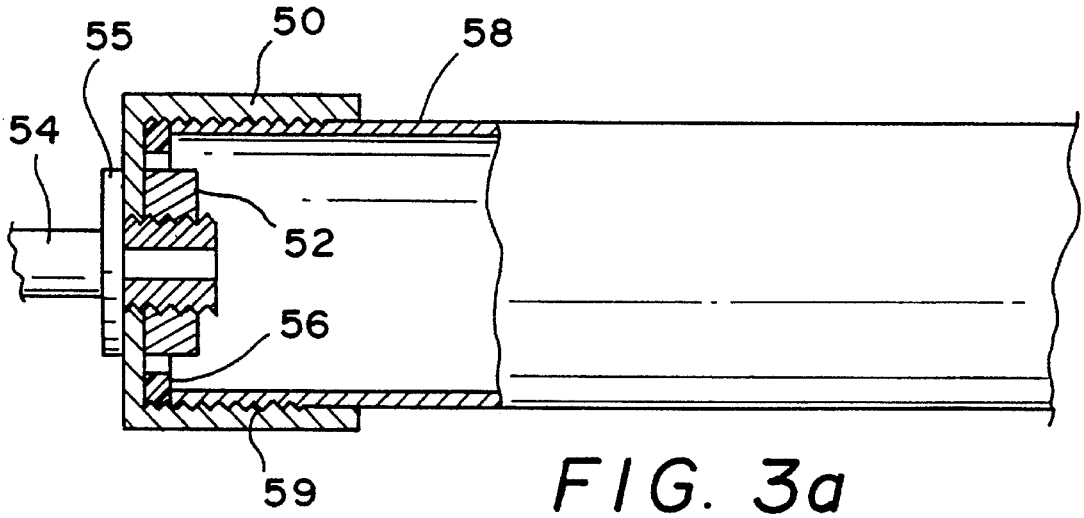
Figure 3B:
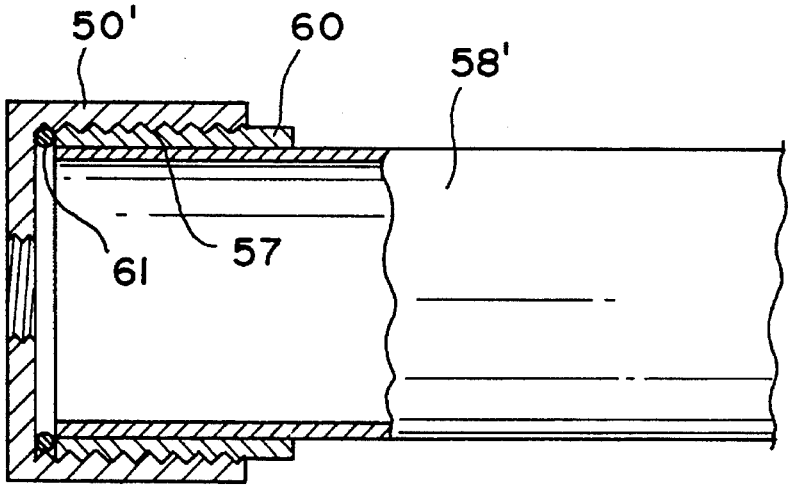

Referring to FIG. 3*a*, a cup 50 is shown as being permanently connected by a nut 52 to the end of a threaded fitting 54. Fitting 54 includes a flange 49 and is permanently connected to a source of compressed gas as previously described. A resilient gas sealing ring or washer 56 may be provided in the bottom of cup 50, if desired, such that the annular end of the elongated tube 58 seals against washer 56 when tube 58 is inserted into the cup. Tube 58 may be secured in cup 50 by the friction of a snug fit, as in the FIG. 1 embodiment, or the inside wall of cup 50 and the outside wall at the end of tube 58 may be threaded as illustrated at 59. It will be understood that threads may be formed on the outside end surface of tube 58 even though it is composed of cardboard; such threads being formed by known pressing or molding operations, for example. However, as shown in FIG. 3*b*, an even stronger fit may be obtained by providing a thin plastic sleeve 60 glued to the outer wall of cardboard tube 58', and threads 57 may be provided on the outer surface of sleeve 60. In either event, tube 58 is readily removable from cup 50 and may be replaced by a new tube prefilled with lightweight articles such as confetti, streamers and/or bubbles and the like. It will also be apparent that instead of resilient washer 56, an O-ring 61 may be substituted in the position of washer 56, or between the inner cup wall and the outer wall of cardboard tube 58 or sleeve 60.

Figure 4A:
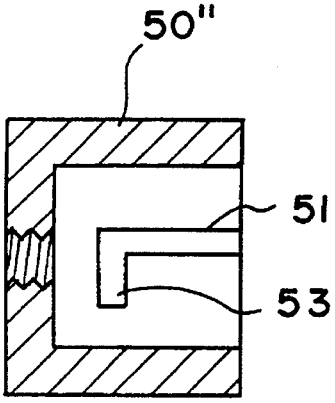
Figure 4B:
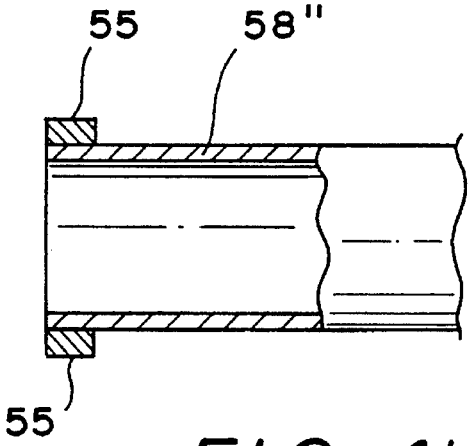

The present invention further teaches that, instead of the above-described threads, a bayonet joint may be provided. For example, as shown in FIGS. 4*a* and *b*, the inner wall of cup 50" may be provided with a pair of slots or channels 51 having right angle portions 53 near the bottom wall of the cup. Sleeve 60 may be provided with a pair of projections 55, as shown in FIG. 4*b*, which slide in slots 51 and into the right angle portions 53 of the slots upon twisting tube 58". Accordingly, tube 58" is merely twisted and removed, and a new tube is inserted and twisted to lock in place.

Figure 5:
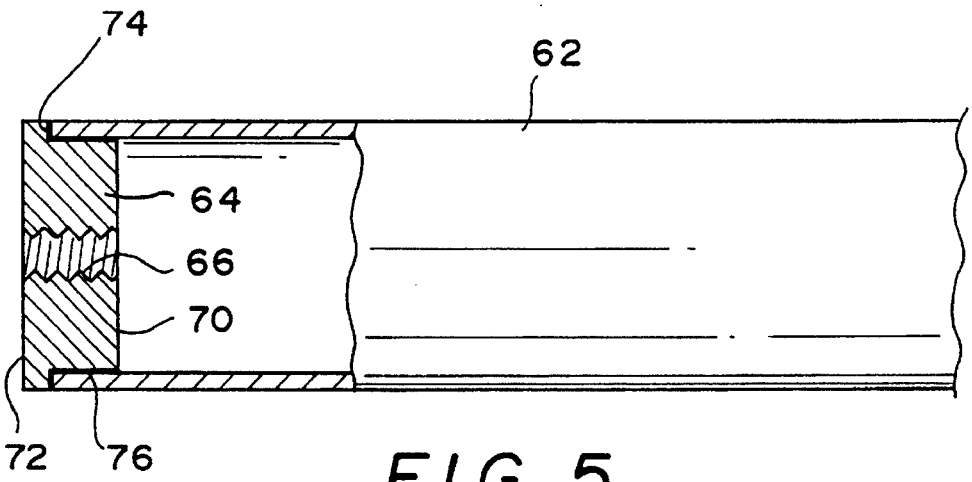

A further embodiment of a readily removable tube is illustrated in FIG. 5 wherein numeral 62 indicates an elongated tube preferably composed of cardboard or thin plastic, such as for example, P.V.C. plastic having a wall thickness in the range of one-sixteenth to three-sixteenth inches. Instead of a cup as in previously described embodiments, the left end of tube 62 is closed by an endwall 64. Endwall 64 may be composed of plastic, but is preferably composed of cardboard, and may for example, have a thickness in the range of one-eighth to one-fourth inches. Endwall 64 is glued or otherwise permanently secured to the end of tube 62 and includes a threaded hole 66 into which the threaded end of a compressed gas fitting such as fittings 44 and 54 of the prior embodiments. It will be understood that endwall 64 may have planar (not illustrated) outside and inside walls 70, 72 with inside wall 72 being glued only to the annular end-surface 74 of tube 62. However, it is preferred that inside wall 72 be countersunk (as illustrated) so that the tube may not only be glued at its annular end-surface 74, but also along the end portion 76 of the inside wall surface of the tube.

Tube 62 is replaced in the same manner as the FIG. 2 embodiment by simply being unscrewed from a threaded compressed gas fitting, such as fittings 44 and 54, and replaced by a new tube which may be preloaded with lightweight articles, or the new tube may be filled after being connected to the compressed gas fitting. However, it will be apparent that the requirement for a cup, such as cups 32, 40 and 50 is eliminated, and hence, the non-biodegradable disposal problems of such metal or plastic cups is also eliminated. While it is preferred that both tube 62 and endwall 64 be composed entirely of cardboard so as to be highly biodegradable, it will be apparent that, even if endwall 64 is composed of plastic, endwall 64 represents an extremely small volume compared to the large, heavy-walled P.V.C. cannons of the prior art.

In the foregoing embodiments, the ready removal of the tubes from the sources of compressed gas have been described as unthreading the elongated tube from a cup, or unthreading the cup from a threaded compressed gas tube, or unlocking a bayonet joint, or untaping the elongated tube from a cup. While each of these methods has very substantial advantages over the prior art systems discussed above, there are some situations in which it is desired to disconnect the spent tube and reconnect a new, preloaded tube in an even faster manner. This is accomplished in the embodiment illustrated in FIG. 6 as will now be described.

Numeral 80 represents an elongated tube which is preferably composed of cardboard, or very thin plastic tubing as previously described with reference to the FIG. 5 embodiment. Tube 80 is permanently secured, as by gluing, to a supporting cup 82 as previously described in the FIG. 2 embodiment. Alternatively, an endwall such as endwall 64 of the FIG. 5 embodiment may be utilized. Cup or endwall 82 includes a threaded hole 83 through which extends the threaded end 86 of a male fitting 90. A nut 88 secures male fitting 90 to the cup or endwall 82. Fitting 90 is one portion of a quick-disconnect coupling the other portion of which is female fitting 92. Female fitting 92 may be mounted wherever desired, and is connected to a source of compressed gas 93 directly through a valve 95, or through a pneumatic line 97 connected to the valve. Quick-disconnect fittings 90 and 92 are commercially available elements such that they need only be described in general as they relate to the present invention.

Male fitting 90 includes reduced diameter portion 94 which is of a size and shape to be engaged by a plurality of metallic retainer balls (not illustrated) which are housed within the body of female fitting 92. Female fitting 92 includes a sleeve 96 with a knurled surface which may be manually slid to the left as viewed in FIG. 6 against the force of an internal spring (not illustrated). When sleeve 96 is manually held in such left position, the retainer balls are released and move radially outwardly to permit enlarged head 98 of male fitting 90 to be inserted into female fitting 92. Male fitting 90 becomes locked therein when sleeve 96 is forced to the right by the internal spring and the retainer balls are forced inwardly by the cam action of sleeve 96. A spring-pressed seal then seals against the end of the male fitting such that the quick-disconnect coupling permits the passage of compressed gas through the quick-disconnect fittings when valve 95 is opened. Once a tube 80 has been shot by momentarily opening valve 95, which may be solenoid-operated, the tube may be removed very quickly by simply sliding sleeve 96 to the left, thereby releasing the male fitting 90. Female fitting 92 is then ready to receive the male fitting of a new tube which may be preloaded with lightweight articles. Thus, in theatrical productions having many shows per day, the use of the quick-disconnect coupling enables tubes to be replaced in less than fifteen seconds, whereby many tubes may be loaded and shot through one female fitting during the same performance. This removes the prior time-constraint of loading which limited the number of tubes which could be shot at a given performance.

As described with respect to the prior embodiments, tube 80 and cup or endwall 82 may be made of all cardboard so as to be economically and ecologically disposable after one or more uses, or tube 80 may be made more durable by being composed of thicker cardboard or plastic such that it may be reloaded and reused many times. It should also be understood that, while conventional fittings 90, 92 are usually made of heavy metal, such as brass alloys, in order to be usable with corrosive fluids, the present invention teaches that such quick-disconnect fittings may be composed of plastic, such as Nylon for example, whereby the cost may be reduced sufficiently to make it economical to discard the male fitting 90 attached to tube 80 after one or a few uses. Alternatively, male fitting 90 may be removed from the tube-and-cup assembly by simply removing nut 88 before the tube-and-cup assembly is discarded. In this mode, male fittings 90 may be reused with other tube-and-cup assemblies thereby substantially reducing both the cost and the volume for disposal.

Figure 6:
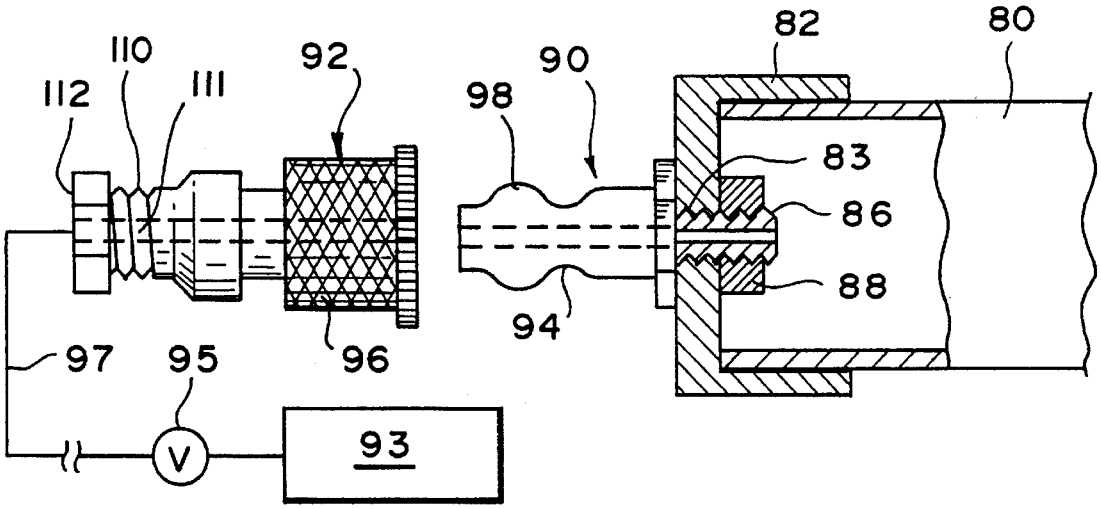
Figure 7A:
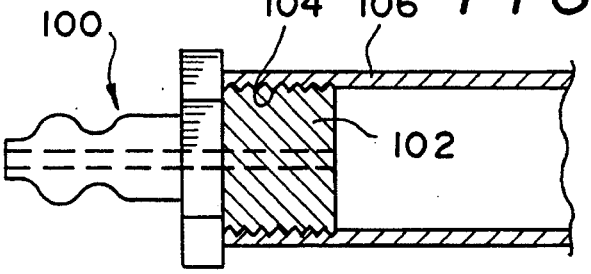
Figure 7B:
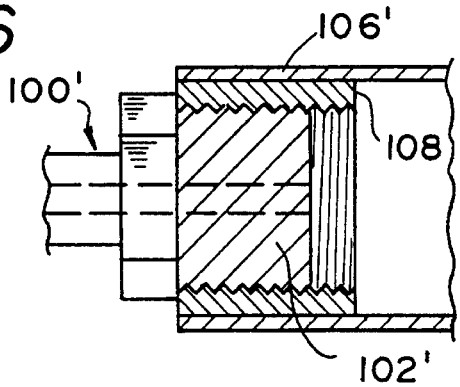

A further alternative embodiment is shown in FIGS. 7*a* and 7*b* in which a male fitting 100 is provided as in the FIG. 6 embodiment. Male fitting 100 may be composed of metal or plastic, and has an enlarged threaded end 102 which is threaded directly into an internally threaded end portion 104 of an elongated tube 106. Tube 106 may be composed of cardboard or thin-walled plastic as previously described, and preferably has an internal diameter (I.D.) in the order of one-half to three-fourth inches. While threads may be formed on internal end portion of tube 106 with the tube composed of cardboard, it may be preferable, particularly for larger tube diameters, to have a threaded plastic sleeve 108 glued or otherwise secured to the internal end portion of the tube as illustrated in FIG. 7*b*. In this manner, the I.D. of tube 106' may be larger than the outer diameter (O.D.) of threaded end 102' of fitting 100'. Thus, tube 106' may have an I.D. of one to several inches while the O.D. of threaded end 102' may remain in the order of one-half to three-fourth inches. As in the FIG. 6 embodiment, female fittings like fitting 92 may be mounted in the ceiling structure, or in any desired location, and tubes 106 and 106' may be attached to, and detached from, such female fittings in a very quick and easy manner between performances, or even during performances.

It is also to be understood that male fittings 90, 100 and 100' may be used along with female fittings, like female fitting 92, in combination with a $CO_2$ cartridge 10 and actuator 12 as previously described with reference to FIG. 1. That is, as shown in FIG. 6 for example, the left end 110 of female fitting 92 may be connected to threaded bolt 24 shown in FIG. 1. This may be accomplished in several ways, such as by the use of an intermediate coupling 112 shown in FIG. 6, or by direct threaded connection between threaded end 110 and threads (not shown) provided in hollow passage 20 of bolt 24; the latter being enlarged accordingly. Alternatively, fitting 110 may be enlarged and provided with internal threads (not shown) in enlarged passage 111 such that threaded bolt 24 of the FIG. 1 embodiment may be threaded into fitting 110. Thus, the actuator, cartridge and female fitting assembly may be rapidly connected to, and removed from, disposable tubes such as tubes 80, 106 and 106' having male fittings 90, 100 or 100' attached thereto in the same manner as previously described with reference to FIGS. 6, 7*a* and 7*b*.

Figure 8:
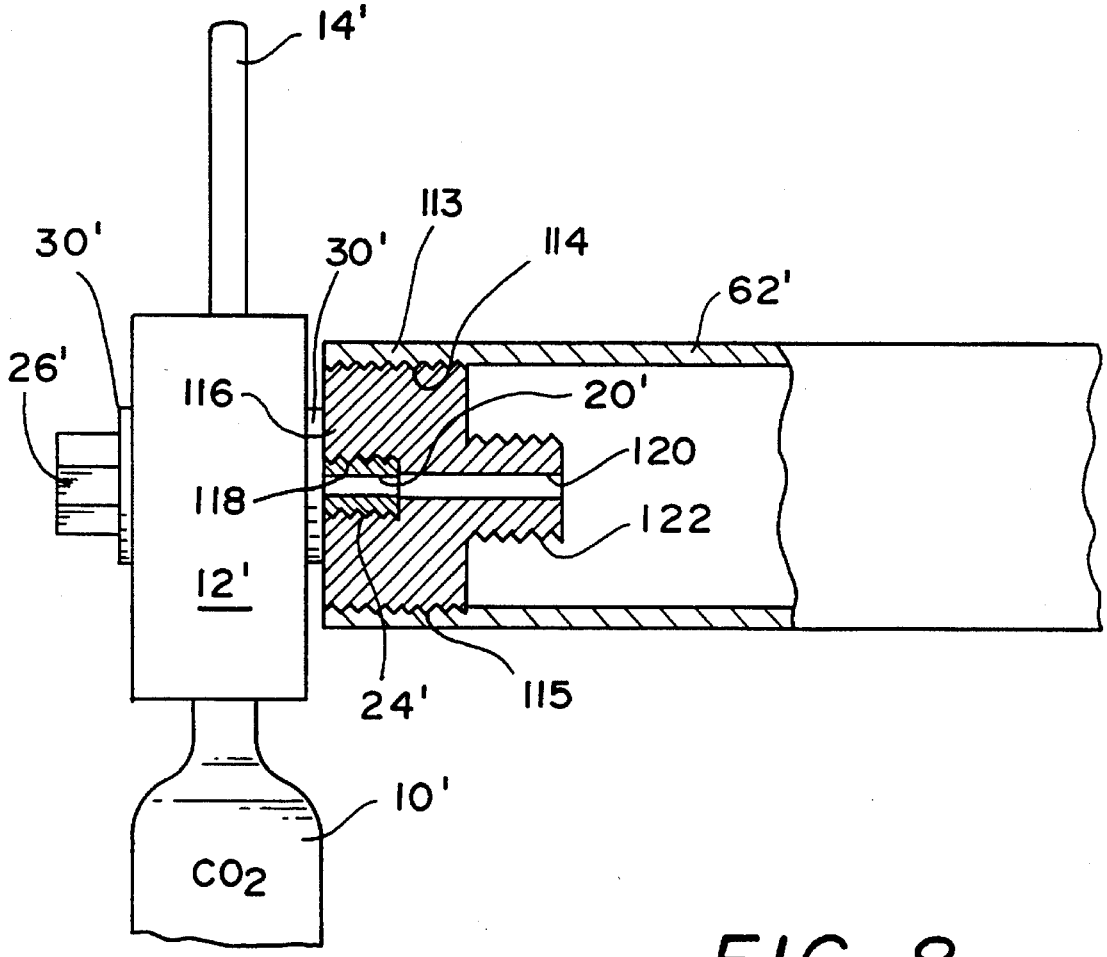

An additional preferred embodiment is illustrated in FIG. 8 wherein numeral 62' indicates an elongated tube, preferably composed of cardboard or thin-walled plastic, such as tube 62 previously described with reference to FIG. 5. However, tube 62' does not have either a cup or an endwall, but rather, end portion 113 of tube 62' has internal threads 114 which receive threads 115 of an adaptor 116. Adaptor 116 may be composed of metal or plastic, and has a threaded bore 118 which receives the threaded end 24' of bolt 26' as previously described with reference to FIG. 1. Internal passage 20' of bolt 24' is connected to $CO_2$ cartridge 10' through actuator 12', and is in communication with a passage 120 in adaptor 116. It is preferred that a tight fit and/or locking nut be provided between threaded bolt 24' and adaptor threads 118 so that the adaptor is permanently, or relatively permanently, connected to the actuator—cartridge assembly and is reused with the actuator and replacement cartridges. The rapid connection and disconnection of multiple tubes 62' is provided by simply screwing and unscrewing threaded tube end 113 onto and off of adaptor 116 in the manner similar to the function of endwall 64 of the FIG. 5 embodiment. However, one of the added advantages of the FIG. 8 embodiment is the elimination of any cup or endwall with the associated cost and increased disposal volume, particularly if such parts are composed of plastic, metal or other non-biodegradable material.

As illustrated in FIG. 8, adaptor 116 is capable of producing an additional advantage in that a single adaptor-actuator assembly may be used with tubes 62' of different diameters. This may be accomplished by providing threads of two or more different diameters, such as threads 115 and 122, on cententric portions of adaptor 116. Thus, smaller tubes, such as for example, those having a three-quarter or one inch diameter, may be threaded onto threads 122, and later in the same performance, or in another performance using the same actuator-adaptor assembly, larger tubes such as those having an inch and one-half or two inch diameters, for example, may be connected to threads 115. This reduces the required number of actuators and adaptors by one-half or more depending upon how many different diameters of threads are provided on the adaptor.

From the foregoing description of several preferred embodiments, it is apparent that the present invention provides substantially lower cost tubes than the prior cannons, and that the tubes of the present invention are either entirely biodegradable, or substantially more biodegradable than the prior, all-plastic, thick-walled cannons. In addition, it will be apparent that the present invention provides easily and quickly operated means for connecting, and disconnecting, launching tubes to and from their sources of compressed gas and, wherein the tubes may be preloaded, if desired, so as to substantially reduce filling time and costs. It will also be apparent to those skilled in the art that many other variations are possible based upon the principles of the invention described hereinabove. Therefore, it is to be understood that the foregoing description is intended to be purely illustrative of the principles of the invention, and that the true scope of the invention is not intended to be limited to the illustrated embodiments, or to be limited in any manner other than as expressly set forth in the following claims including all legal equivalents thereof.

What is claimed is:

1. A readily disposable and biodegradable cannon for launching confetti into the air comprising:

(a) an adaptor;

(b) first connector means for connecting said adaptor to a source of compressed gas;

(c) an elongated hollow tube, said tube being composed of cardboard and being of a diameter and length such as to contain a large plurality of said confetti, said cardboard tube having first and second spaced-apart ends;

(d) readily separable connector means for directly connecting said first end of said cardboard tube directly to said adaptor and for readily removing said cardboard tube from said adaptor after said confetti has been launched into the air; and (e) said readily separable connector means comprising external threads on said adaptor and matching internal threads on said first end of said cardboard tube, and wherein said adaptor includes two sets of said external threads of different diameters whereby tubes of different diameters may be removably connected to said adaptor.

2. A readily removable cannon for launching confetti into the air comprising:

(a) a source of compressed gas;

(b) a threaded fitting connected to said source of compressed gas;

(c) an elongated hollow tube filled with confetti and having a length of at least 18 inches between first and second ends;

(d) said first end of said hollow tube having a threaded portion; and (e) an adaptor having first threads of a size and shape such as to be connected to said threaded fitting, and said adaptor having second threads of a size and shape such as to be readily removably connected to said threaded portion of said first end of said hollow tube for readily disconnecting said tube from said adaptor after said confetti has been launched into the air from said tube, and wherein said adaptor further includes third threads, said third threads being of a size different from that of said second threads for removably receiving another hollow tube having a different diameter than said hollow tube.

3. A readily removable cannon for launching confetti into the air comprising:

(a) a source of compressed gas;

(b) a threaded fitting connected to said source of compressed gas;

(c) an elongated hollow tube filled with confetti and having a length of at least 18 inches between first and second ends;

(d) said first end of said hollow tube having a threaded portion; and (e) an adaptor having first threads of a size and shape such as to be connected to said threaded fitting, said adaptor comprising a solid cylindrical element having a cylindrical exterior surface, said cylindrical element including a central bore for the passage of compressed gas therethrough, and wherein said adaptor includes second and third threads on said exterior surface of different diameters whereby elongated hollow tubes of different diameters may be removably connected to said solid cylindrical adaptor.

* * * * *